United States Patent [19]

Norden

[11] 4,053,202

[45] Oct. 11, 1977

[54] LAY-IN CONNECTORS

[76] Inventor: Alexander R. Norden, 350 Central Park West, New York, N.Y. 10025

[21] Appl. No.: 680,739

[22] Filed: Apr. 27, 1976

[51] Int. Cl.[2] ..... H01R 7/08

[52] U.S. Cl. ..... 339/272 UC

[58] Field of Search ..... 339/272; 24/135 N

[56] References Cited

U.S. PATENT DOCUMENTS

| | | | |
|---|---|---|---|
| 1,562,053 | 11/1925 | Ratigan | 24/135 N |
| 3,742,431 | 6/1973 | Kobyner | 339/272 UC |
| 3,876,279 | 4/1975 | Underwood | 339/272 UC |

FOREIGN PATENT DOCUMENTS

| | | | |
|---|---|---|---|
| 545,928 | 3/1956 | Belgium | 339/272 UC |
| 1,396,645 | 6/1975 | United Kingdom | 339/272 UC |

*Primary Examiner*—Joseph H. McGlynn

[57] ABSTRACT

So-called lay-in connectors include a body or first member having a base portion and side walls, and a screw-bearing second member. There are in-turned overhangs along the upper margins of the walls of the first member cooperating with formations at the top of the screw-bearing member, arranged to forestall spreading of the walls when the screw is tightened on an inserted conductor.

Ribs on the respective walls of the base member between the base portion and the overhangs cooperate with ribs along the lower side of the screw-bearing member to augment the resistance of the walls to outward pressure that may develop when the screw is tightened on an inserted conductor.

As a separate but related feature, the overhangs and the screw-bearing member have interengaging detent means resisting sliding removal of the screw-bearing member; and the cooperating ribs are shaped to provide upward thrust that releasably holds the detent means in interengagement to prevent accidental disassembly of the connector.

14 Claims, 7 Drawing Figures

LAY-IN CONNECTORS

FIELD OF THE INVENTION

This invention relates to electrical connectors, and in particular to lay-in connectors.

BACKGROUND OF THE INVENTION

Lay-in connectors characteristically have a body or first member that is generally channel-shaped when viewed endwise, and a top screw-threaded second member, plus a screw through the top member to be tightened against a conductor or conductors laid in the connector. The first member has a base portion and upstanding walls. In-turned marginal portions or overhangs on the walls cooperate with the screw-threaded member, to resist upward thrust of the latter when its screw is tightened. The cooperating surfaces of the overhangs and of the top member slope inward and downward, so that any upward thrust of the screw-bearing member against the overhangs serves to develop inward force on the overhangs, guarding against spreading of the walls of the body or first member.

The screw-threaded member is completely removed from the base member when a conductor is to be laid into place between the walls of the first member. Then the screw-threaded member is shifted into position over the conductor but below the overhangs. Tightening of the screw squeezes the inserted conductor against the base portion and deforms the conductor (or conductors) outward against the walls of the base member.

While the overhangs resist spreading of the walls along their top margins, there is a tendency of the walls, when tall and thin, to bulge outward due to one or more conductors laid in place between the walls and squeezed by the screw.

It is of considerable practical importance to maintain assembly of the parts of a lay-in connector when it is not in use. One common way of doing this is to use a screw whose diameter is greater than the separation between the walls of the base member, that separation being locally enlarged so as to form recesses in the opposite wall surfaces to receive the screw. So long as the screw is received in those recesses, the screw-bearing member cannot slide out of place. It then becomes necessary to unscrew the screw for retracting it from such recesses before the screw-bearing member can be removed in preparation for laying-in a conductor. The screw diameter must be larger than the average space between the walls of the first member. As a result, the design of that form of lay-in connector has a number of constraints in connection with the feature of preventing its disassembly, where those constraints are unrelated to — and may encroach upon — the considerations involved in the design of the connector for its prime function, i.e., making a connection.

SUMMARY OF THE INVENTION

An object of the invention resides in the provision of improved lay-in connectors obviating one or more of the foregoing limitations of lay-in connectors.

A further object of the invention resides in the provision of a novel lay-in connector whose base member has walls bearing a first pair of ribs and whose screw-bearing member has a second pair of ribs straddling said first pair of ribs for inhibiting outward deformation of the walls when the screw is tightened on one or more conductors.

A further object of the invention resides in the provision of a novel lay-in connector whose base member and screw-bearing member have interengaging detent means resiliently and thus releasably held in interengagement.

The illustrative embodiments of the invention detailed below and shown in the accompanying drawings include a customary channel-shaped first member with in-turned overhangs that cooperate with the upper surface of the screw-bearing member. Additionally, the illustrative embodiments include ribs on the walls of the first member between the base portion and the overhangs, these ribs being straddled by ribs projecting downward from margins of the screw-threaded member. These cooperating ribs achieve two separate functions. As interengaging ribs, they resist outward bulging of the side walls in case outward pressure develops when the screw is tightened on one or more conductors. The cooperating ribs are formed as cams and they are supported resiliently by the first member. Interengaging formations on the overhangs and on the top of the screw-bearing member include detent means resisting sliding the screw-bearing member out of the channel-shaped member. The resilience of the latter causes the cooperating pairs of ribs to maintain the detent means in effect releasably.

The foregoing and other novel features of the invention and their advantages will be more fully understood and appreciated from the following detailed description of two illustrative embodiments of the invention, incorporating its various aspects, and from the accompanying drawings.

THE DRAWINGS

Figure 1:
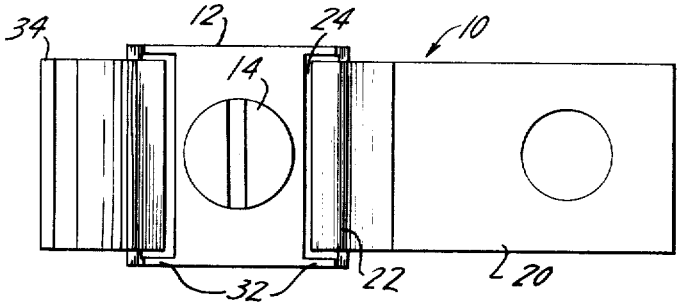
FIG. 1 is a top plan view of a novel lay-in connector, as an illustrative embodiment of the invention.
Figure 3:
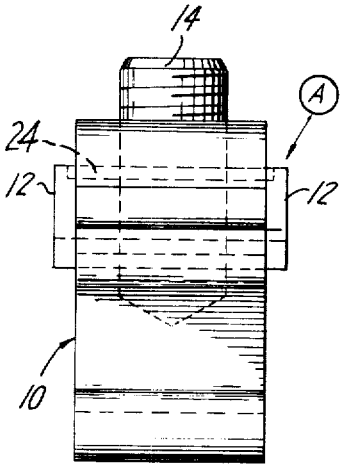
FIG. 3 is an end view of the connector of FIG. 1 as seen from the left of FIG. 2.

In FIGS. 1–5, a first member or body 10 contains a second member 12, bearing a screw 14. In the further description, words like "upward" are used as terms of reference, and not as an indication that the connector must be used in the position shown in the drawings.

Figure 2:
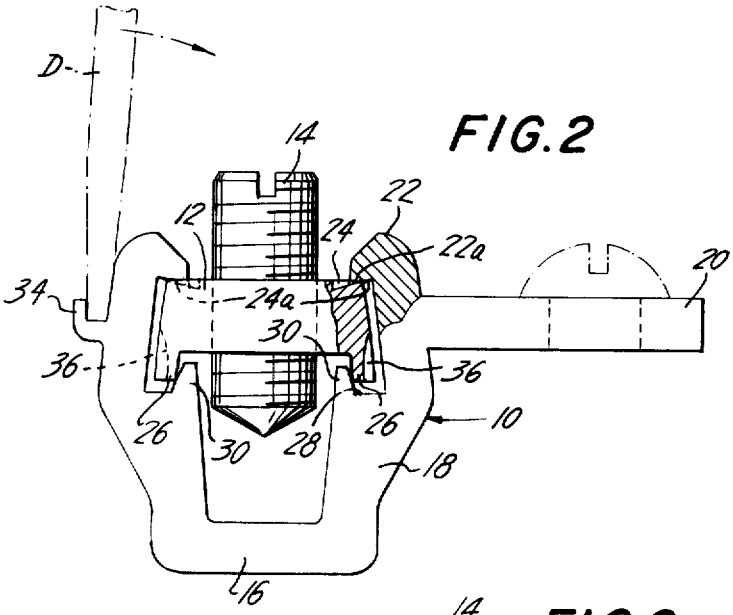
FIG. 2 is a side elevation of the connector of FIG. 1.
Figure 4:
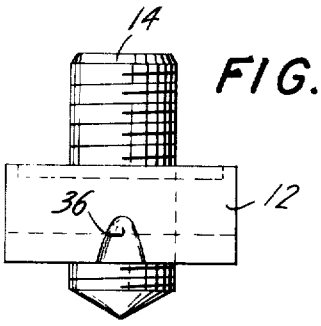
FIG. 4 is a lateral view of a component part of the connector of FIGS. 1–3, as viewed in FIG. 3.

Body or first member 10 is channel-shaped as viewed in FIG. 2, including a base portion 16 and opposite walls 18 upstanding from base portion 16. A mounting ear 20 may be screwed to a support, or it may also serve as a terminal for connecting body 10 to another conductor.

Second member 12 is confined against movement away from base portion 16 by portions 22 of walls 18 that overhang the upper surface of member 12, and are called "overhangs." In the construction shown, the inner margins of overhangs 22 are aligned with the vertical inner surfaces of walls 18 extending from base portion 16. Overhangs 22 are received in grooves 24 in the top of screw-bearing member 12. Each overhang 22 and member 12 have cooperating upward and outward sloping cam surfaces **22*a* and 24*a*, respectively. In an example, this slope is about 25° to the horizontal. In use of the connector, screw 14 is tightened against one or more conductors, which may be solid or stranded. Screw 14 may otherwise bear against a pressure foot or clamping jaw (not shown). The reaction forces act at cooperating cam surfaces 22a and 24a to draw overhang portions 22 of walls 18 toward each other. This overcomes a tendency of the walls to be pushed apart by conductors tightened by screw 12 in the space between walls 18. The cams shown, and the provision of grooves 24, are illustrative presently preferred forms of cooperating formations that resist spreading of walls 18**.

As best seen in FIG. 2, screw-bearing member 12 has downward protruding marginal ribs 26 received in grooves 28 that partially define upward protruding ribs 30. Body 10 is resilient, and the parts are proportioned so that the ribs 30 bear against ribs 26 and bias member 12 upward, pressing cam surfaces 22a and 24a against each other. For this purpose, the surfaces of ribs 30 that behave as cams have a steep slope, about 15° departure from the vertical in an example. This is illustrative, for cam surfaces of ribs 30 evidently need not be flat. However, in some cases (discussed below) it is important for the local contacts or tangency between ribs 26 and 30 to be made at a steep angle.

Interengaging formations are provided for resisting displacement of member 12 horizontally along the elongated overhangs 22. In broad concept these interengaging formations can be loacted anywhere, so long as they are maintained in interengagement by the resilience of member 10 and by cooperation of first pair of ribs 26 with second pair of ribs 30. However, it is both convenient and distinctive to locate the interengaging formations at the ends of elongated overhangs 12 and grooves 24. Detents 32 close off grooves 24 at their opposite ends, and these detents cooperate with the ends of the elongated overhangs 22. Firm pressure applied to member 12 in the direction and at the place indicated by arrow A in FIG. 3 may overcome the resilience of body 10, facilitated by the mechanical advantage realized from the steep cam angle of ribs 26 and 30, to allow detents 32 at one end of member 12 to drop out of obstructing relation to the opposed ends of overhangs 22. Member 12 can then be shifted along overhangs 22 and out of assembly to member 10.

In case walls 18 and base portion 16 are particularly thick and wide (due to required high current-carrying capacity) ordinary pressure at arrow A may not release detents 32. In that case, a screw driver D may be inserted in a groove formed by rib 34 near the top of one wall 18 to apply pressure in the direction to move one wall 18 toward the other. This moves ribs 30 slightly closer together and enables detents 32 to be released preparatory to removing member 12.

Figure 6:
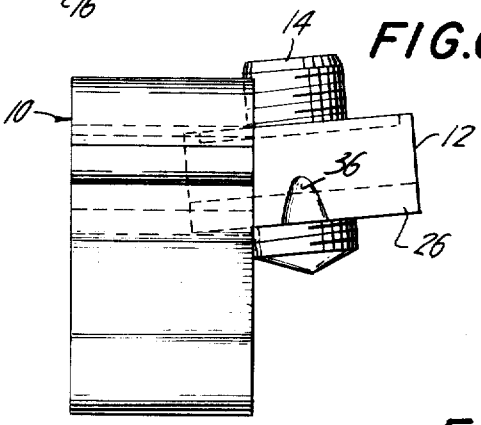
FIG. 6 is an end view of the connector of FIG. 1, like FIG. 3, showing the parts partially assembled.
Figure 5:
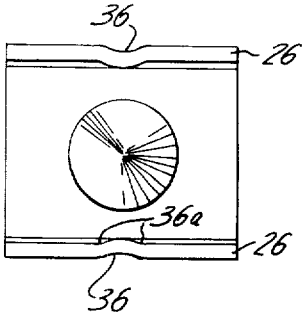
FIG. 5 is a bottom plan view of the component part of FIG. 4.

When member 12 has been removed, heavy electrical conductors may readily be laid into the space between walls 18. Member 12 is initially inserted as shown in FIG. 6, and then forced back to its assembled condition as in FIGS. 1–3. Screw 14 is tightened to secure the connection.

The following distinctive feature is added to avoid close tolerances, especially where body 10 is thick and resilient but stiff, perhaps requiring screw-driver leverage for release as described above. Between the ends of ribs 26 (FIG. 4–6, and see also FIG. 2) there are two deformations 36, providing bearing points against ribs 30 that are closer together than the separation between ribs 26 along most of their lengths. In that case, it is relatively easy to insert an end portion of member 12 into member 10 (FIG. 6). The rest of the insertion is accomplished with deliberate but moderate force. The gently sloping surfaces 36a of deformations 36 serve as cams minimizing the required effort.

Members 10 and 12 are economical parts, being short pieces of aluminum extrusions in the preferred embodiment of FIGS. 1–6. As such, ribs 26, 30 and 34 are all parallel, parallel to overhangs 22 and to the top of member 12. The cut piece of extrusion used to make part 12 has a screw-threaded hole and grooves 24 added in supplementary operations, as is true of deformations 36. Despite its low-cost construction, the described lay-in connector is remarkably easy to use.

Figure 7:
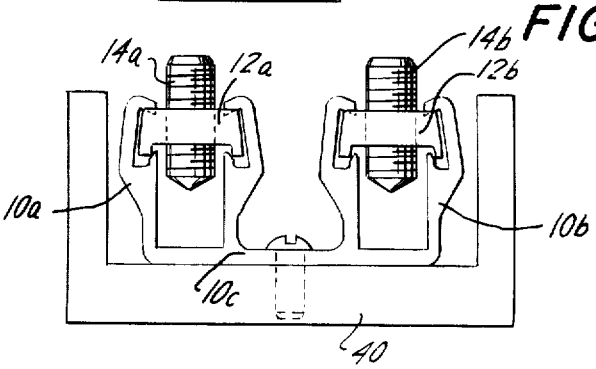
FIG. 7 is a further embodiment of various features of the invention.

A modification is shown in FIG. 7. Two bodies 10a and 10b are united by a connecting portion 10c. Screws 14a and 14b are carried by members 12a and 12b. The unit 10a, 10b, 10c can be made as a short length of an extrusion. It is mounted on an insulator 40. The dual connector can make connection between plural wires laid into its separate halves. In this example, the wall thickness of bodies 10a and 10b is moderate. Both rib 34 and deformations 36 are omitted, as unnecessary.

The illustrative embodiments described above and shown in the accompanying drawings are exemplary; but they may be modified readily by those skilled in the art and adapted to various applications. Consequently, the invention should be construed broadly in accordance with its full spirit and scope.

What is claimed is:

1. A lay-in connector including a resilient first member having a base portion and two opposite and spaced-apart walls upstanding integrally from said base portion, said walls having inward projecting overhangs spaced from said base portion, a screw-threaded second member removably received between said walls and having marginal portions underlying said overhangs, said second member being movable along the overhangs for removal from said first member, and a screw extending through said second member for tightening a conductor in place in said first member, the overhangs cooperating with the second member for resisting displacement of the latter away from said base portion when the screw is tightened, said walls having a first pair of ribs projecting upward between said base portion and said overhangs, and said second member having a second pair of ribs projecting downward and flanking said first pair of ribs, respectively, for resisting outward bulging of the walls when outward pressure is developed against the walls by one or more conductors tightened in place between the walls by the screw.

2. A lay-in connector in accordance with claim 1, wherein said overhangs and the upper side of said second member have interengaging formations resisting spreading of said walls when said screw is tightened.

3. A lay-in connector in accordance with claim 1, wherein said overhangs and said second member have releasably interengaging formations for blocking said second member from being moved along said overhangs and thus removed.

4. A lay-in connector in accordance with claim 3, wherein said first and second pairs of ribs have respective pairs of cooperating cam surfaces sloping inward and upward, the walls of said resilient first member resiliently biasing said cam surfaces to hold said interengaging formations releasably in interengagement in the absence of a tightened conductor for preventing inadvertent removal of said second member.

5. A lay-in connector in accordance with claim 1, wherein said overhangs and the top of said second member have interengaging formations for preventing spreading of the side walls when said screw is tightened and for preventing movement of said second member along said overhangs, and wherein said first and second pair of ribs have inward and upward sloping cooperating cam surfaces resiliently held in mutual engagement by said first member in the absence of a tightened conductor for holding said interengaging formations releasably interengaged.

6. A lay-in connector in accordance with claim 5, wherein said interengaging formations of the overhangs and of said second member include cam surfaces sloping outward and upward, tending to pull the walls together when said screw is tightened.

7. A lay-in connector in accordance with claim 5, wherein said first member has means for mounting the connector firmly on a fixed support and wherein one of said walls has a tool-engageable formation for applying leverage thereto to relieve the bias that holds the interengageable formations in interengagement, thereby to release the second member for sliding disassembly from the first member.

8. A lay-in connector in accordance with claim 5, wherein said first and second members are extrusions whose said overhangs and ribs are straight, elongated and parallel.

9. A lay-in connector in accordance with claim 8, wherein said interengaging formations include detents at the ends of said elongated overhangs, said second pair of ribs of said second member having inward deformations spaced from the ends thereof and cooperable with the first pair of ribs when the second member is fully assembled to said first member in developing the bias that holds the interengaging formations releasably interengaged, said second member being freely insertable into partial assembly to said first member until it engages said deformations.

10. A lay-in connector, including a first member having a base portion and two opposite and spaced-apart walls upstanding integrally from said base portion, said walls having inward projecting overhangs spaced from said base portion, a screw-threaded second member removably received between said walls, underlying said overhangs and slidable along the overhangs for removal from the first member, and a screw extending through said second member for tightening a conductor in place in said first member, at least one of said overhangs and the top of said second member having interengageable formations effective when in interengagement for inhibiting sliding of said second member along said overhangs to disassemble the second member from the first member, and said connector having means acting resiliently to bias said first and second members relative to each other for holding said interengageable formations releasably in interengagement in the absence of a tightened conductor.

11. A lay-in connector in accordance with claim 10, wherein said holding means includes (a) a first pair of ribs projecting inward from said walls and projecting away from said base portion of the first member; and (b) a second pair of ribs extending from said second member and projecting toward said base portion and flanking said first pair of ribs, said first and second pairs of ribs having pairs of cooperable cam surfaces that slope inward and upward and said walls providing resilient bias of the cam surfaces, for biasing the interengageable formations in interengagement in the absence of a tightened conductor.

12. A lay-in connector as in claim 10 wherein the space between the opposite inner surfaces of said walls is greater than the maximum diameter of the screw whereby the screw-threaded second member having a screw threaded therein and projecting between said inner surfaces of said walls can be slid along said overhangs and removed from said first member when said interengageable formations have been released from interengagement.

13. A lay-in connector in accordance with claim 10, wherein said holding means includes first and second cam means on said first and second members, respectively, cooperable with each other for holding said interengageable formations in interengagement, said first member resiliently supporting said first cam means in cooperation with said second cam means, said holding means releasing said interengagement upon flexing of said first member.

14. A lay-in connector in accordance with claim 13, wherein said first member has means for mounting the connector firmly on a fixed support and wherein one of said walls has a tool-engageable formation for applying leverage thereto to relieve the bias that holds the interengageable formations in interengagement, thereby to release the second member for sliding disassembly from the first member.

* * * * *